US005292295A

United States Patent [19]

Gerlach

[11] Patent Number: 5,292,295

[45] Date of Patent: Mar. 8, 1994

[54] EXERCISE HOOP

[76] Inventor: Michael J. Gerlach, 21133 Stonecrop Pla., Ashburn, Va. 22011

[21] Appl. No.: 923,553

[22] Filed: Aug. 3, 1992

Related U.S. Application Data

[63] Continuation-in-part of Ser. No. 826,794, Jan. 28, 1992, abandoned, which is a continuation-in-part of Ser. No. 476,801, Feb. 8, 1990, Pat. No. 5,102,119, which is a continuation-in-part of Ser. No. 250,172, Sep. 28, 1988, Pat. No. 4,902,004.

[51] Int. Cl.[5] ..... A63B 25/08

[52] U.S. Cl. ..... 482/77; 482/92; 482/121

[58] Field of Search ..... 482/77, 908, 33, 15, 482/78, 73, 92; 267/158, 160; D21/167

[56] References Cited

U.S. PATENT DOCUMENTS

| | | | |
|---|---|---|---|
| 2,995,377 | 8/1961 | Miihlroth | 482/77 |
| 3,377,722 | 4/1968 | Downing | 482/77 |
| 4,492,374 | 1/1985 | Lekhtman et al. | 482/77 |
| 4,696,467 | 9/1987 | Markow | 482/77 |

FOREIGN PATENT DOCUMENTS

| | | | |
|---|---|---|---|
| 0358863 | 9/1922 | Fed. Rep. of Germany | 482/77 |

*Primary Examiner*—Richard J. Apley
*Assistant Examiner*—Jerome Donnelly
*Attorney, Agent, or Firm*—Finnegan, Henderson, Farabow, Garrett and Dunner

[57] ABSTRACT

An exercise device made from one or more lengths of metallic or a fiber reinforced plastic matrix material. A portion of the length of material adjacent opposite ends are attached to one another to form an annular spring in either a U-shaped, tear drop, elliptical, or circular shape. A hand grip and foot support are mounted to the annular spring. In one embodiment, the annular spring means is mounted in a metal housing of limited spring characteristics. The U-shaped, tear drop, and circularly configured annular spring has a stabilizing bar telescopically mounted to the annulus spring at diametrically opposite locations. The elliptical embodiment includes a pair of annular elliptical springs mounted one on top of the other at locations intersecting the minor axis. Other embodiments have a stabilizing bar offset from the annulus with one end of the bar fixedly clamped to the annulus and a portion of the bar adjacent the opposite end offset from the annulus and slidably clamped thereto.

One or more arcuate spring segments may be mounted to the annular spring for adjusting the weight range and bouncing characteristics. An elastomer band may be mounted to the annular spring of any of the embodiments so that it extends substantially parallel to the utility surface for increasing the weight range, and rebound of the device.

21 Claims, 15 Drawing Sheets

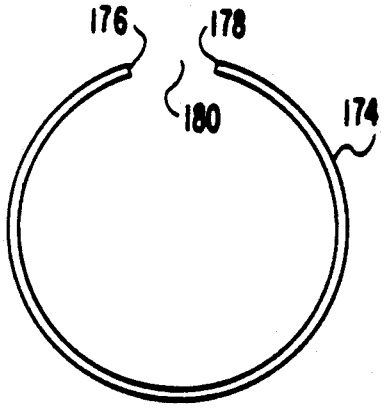
FIG. 26
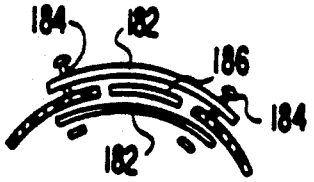
FIG. 27
FIG. 28
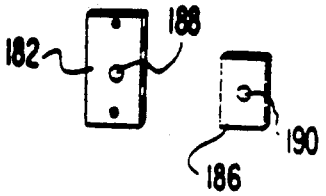
FIG. 29
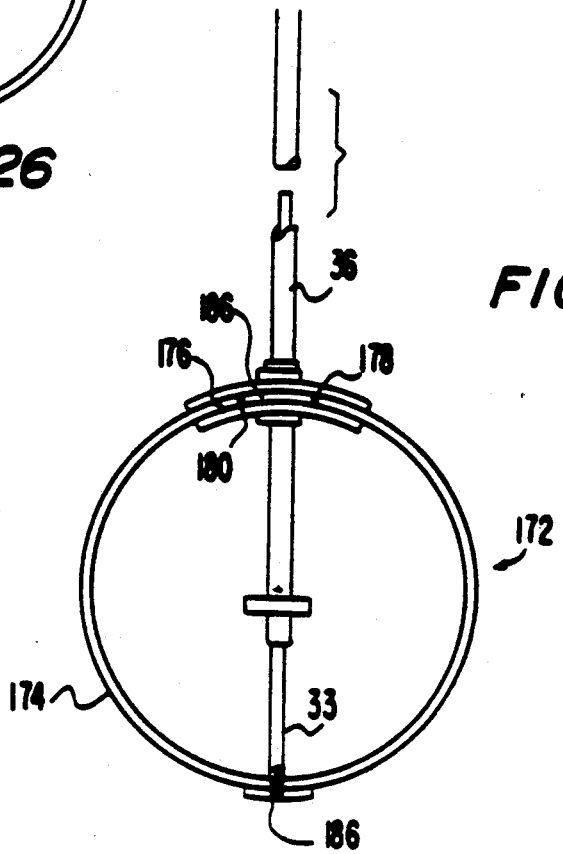
FIG. 25

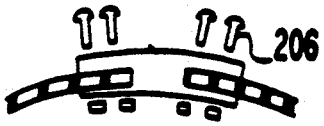
FIG. 33
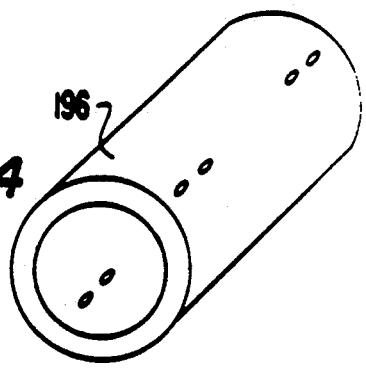
FIG. 34
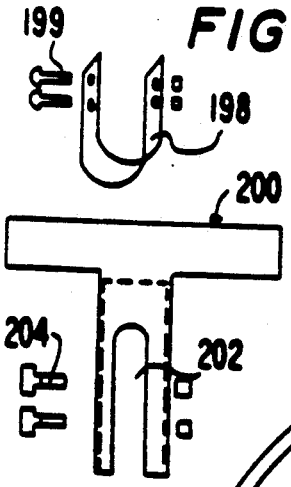
FIG. 32
FIG. 31
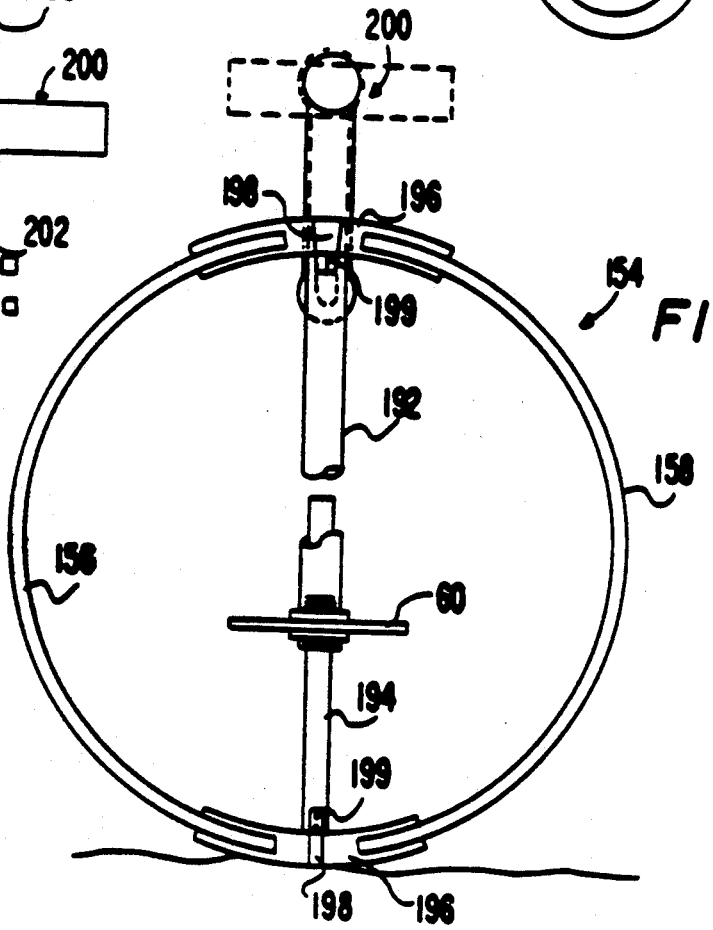
FIG. 30

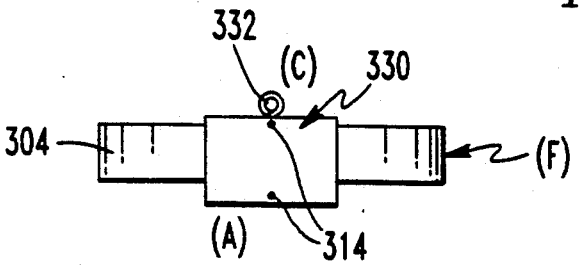
FIG. 51(b)
FIG. 51(a)
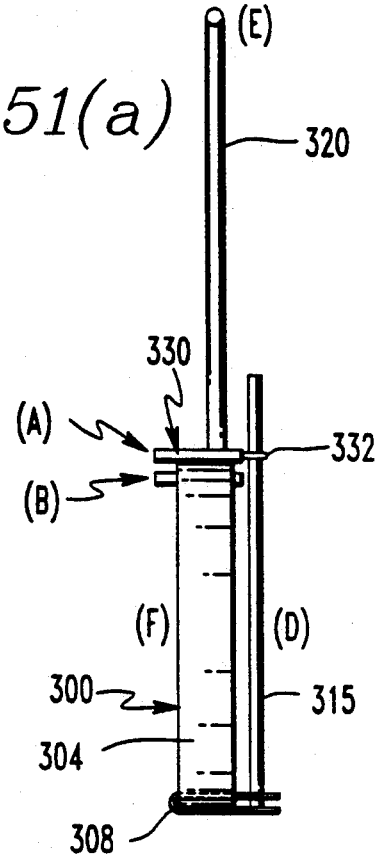
FIG. 52
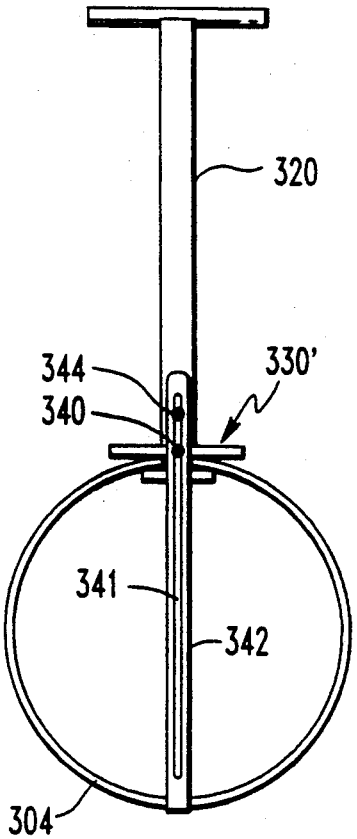
FIG. 53
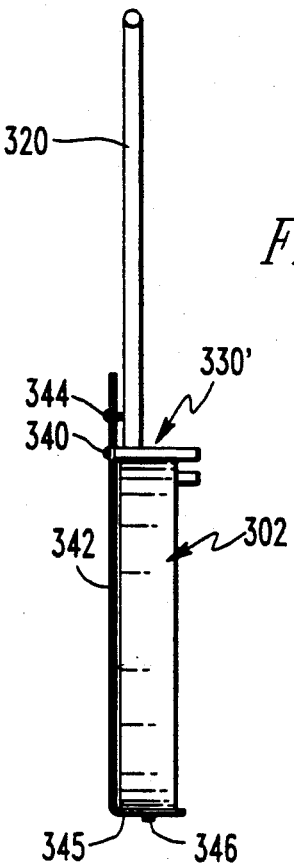
FIG. 54(b)
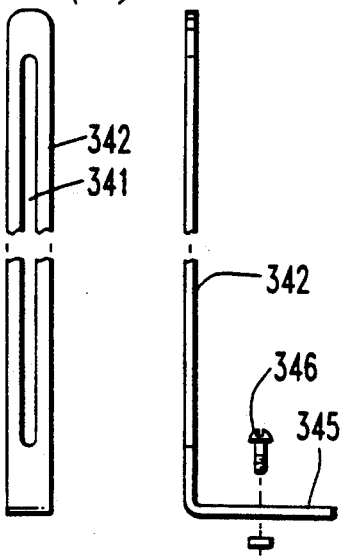
FIG. 54(a)

EXERCISE HOOP

This is a continuation-in-part of U.S. patent application Ser. No. 07/826,794 filed Jan. 28, 1992 now abandoned, which in turn is a continuation-in-part of Ser. No. 07/476,801 filed Feb. 8, 1990 now U.S. Pat. No. 5,102,119 which in turn is a continuation-in-part of Ser. No. 07/250,172 filed Sep. 28, 1988 now U.S. Pat. No. 4,902,004, the entire disclosures of which are relied upon and incorporated by reference herein.

BACKGROUND OF THE INVENTION

1. Field of the Invention

The present invention relates to a recreational exercise device; and more particularly to an exercise device of the type where user locomotion is effected by bounding.

2. Discussion of the Related Art

An exercise device of the type known as a pogo stick has been known for many years. Pogo sticks appear to offer fun and enjoyment to users of all ages, as well as provide beneficial exercise. They are relatively safe to use, even for young children. However, they have never gained the widespread popularity, either as recreational or exercise devices, as did the spring type hobby horses for the very young children, or the trampoline for older children and adults. Some of the lack of this widespread popularity can be attributed to the inherent jolting action or skeletal shock that the user suffers just prior to the users weight overcoming the friction and stiffness of the confined coil spring as the base of the pogo stick strikes the ground. The limitations of the confined spring and friction cause the conventional pogo stick to provide a bouncing action similar to the short hops of a rabbit. A good deal of effort is required in order to effect even these short hops, which detract substantially from the fulfillment associated with being propelled upwardly and forwardly by the spring action.

Another disadvantage that limits pogo-stick popularity is the required utility surface. By its very nature, the conventional pogo-stick must be used on a concrete, asphalt or hardwood surface in order to effect any bouncing action whatsoever. This, of course, limits the areas of use and makes them quite impracticable for playground or backyard use.

Of course another characteristic of conventional pogo-sticks is their difficulty of manufacture. Except for the very young children, the resistance to shock and needed strength of the various parts inordinately increases the cost of manufacturing. Also, the pogo-stick must be sized accurately for each user weight range.

Various proposals have been offered in an attempt to overcome some of the above limitations. For example, in an attempt to overcome some of the deficiencies of coil springs, a pogo-stick was proposed having a telescoping piston and cylinder arrangement incorporating an air spring. The air pressure in the cylinder is varied depending on the weight of the user. Also, other types of spring action, such as rubber balls, have been proposed. In an attempt to provide a device that would operate on lawns or other penetrable surfaces, a plurality of radially spaced spring legs were used to support the device. The above devices appear to be satisfactory for the purposes intended; however, in many instances, disadvantages were overcome at the expense of other features. For example, the device having the air spring was relatively complicated and expensive to manufacture. The multi-legged device occupied a relatively large area, and tended to be unstable when more weight was exerted on certain of the spring legs than other. Additionally, the above mentioned examples, with the possible exception of the air spring, must be individually sized for the various weight ranges of the user.

SUMMARY OF THE INVENTION

One of the objects of the present invention is to provide an improved exercise device that overcome the deficiencies and limitations of a conventional pogo-stick.

Another object of the present invention is to provide an improved exercise device that minimizes skeletal shock and provides a smooth bouncing action more like a kangaroo than a rabbit.

A further object of the present invention is to provide an improved bouncing type exercise device that ca be effectively used on utility surfaces other than concrete or the like.

A further object of the present invention is to provide an improved bouncing type exercise device that is user adjustable to be variably spring loaded for different weights and spring action.

Still another object of the present invention is to provide an improved exercise device of the pogo-stick type that exhibits minimal friction between moving parts.

A still further objects of the present invention is to provide an improved exercise device of the pogo-stick type that is simple in construction, relatively easy to manufacture, and reliable and stable in operation.

Additional objects and advantage of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects, and in accordance with the purpose of the invention as embodied and broadly described herein, an exercise device for bouncing a user carried by the device from a utility surface, comprises an elongate resilient member having opposite ends; means for connecting the opposite ends in juxtaposition forming an annulus with a supporting portion, said supporting portion having a foot support and a handle spaced in a longitudinal direction from the foot support for grasping by a user when standing on the foot support, said annulus bouncing a user off the utility surface engaged by the annulus upon the flexing of the annulus in response to a jumping motion of a user supported by the supporting portion; and a linear stabilizing bar telescopically mounted to the supporting portion and fixedly mounted to the annulus for maintaining substantial symmetry of flexure in response to a compressive and recovery force in the longitudinal direction.

In another aspect an exercise device for bouncing a user carried by the device from a utility surface comprises spring means having a peripheral annulus for bouncing a user with a predetermined weight range off the utility surface engaged by the annulus upon the flexing of the annulus in response to a jumping motion of the user, stabilizing means having a longitudinal axis fixedly mounted to the annular spring means at first and second opposite locations, a foot support mounted on either said spring means or said stabilizing means for supporting the weight of a user at times when the peripheral annulus is upright and engaging the utility surface, a handle mounted to the stabilizing means spaced from the foot support for grasping by a user standing on the foot support; and weight adjusting means, including an elastomeric band mounted to diametrically opposite locations of the peripheral annulus of the spring means, said locations being spaced from and intermediate the first and second opposite locations of the annulus.

In another aspect, the exercise device of the present invention comprises a plurality of annular springs fastened together at their respective peripheries in the same plane; and a rigid elongate member having a foot support and a handle adjacent opposite ends fixedly mounted to at least one of the plurality of annular springs and extending outwardly from said at least one spring in diametrical alignment with at least two of the plurality of annular spring said at least two of the plurality of annular springs being mounted vertically one above the other in position with a user standing on the foot support and grasping the handle.

In still another aspect an exercise device for bouncing a user carried by the device from a utility surface, comprises a member having opposite ends defining a longitudinal axis extending therebetween with a hand grip adjacent one of the opposite ends and a foot support longitudinally spaced from the hand grip; and spring means including a first elliptical annulus and a second elliptical annulus of resilient material, the first elliptical annulus, having a major axis and a minor axis, with an upper peripheral portion and a lower peripheral portion defining an elliptical plane, said first elliptical annulus being fixedly mounted at the upper peripheral portion thereof to said longitudinal member with the longitudinal axis extending substantially normal to the major axis in the elliptical plane; the second elliptical annulus having a major and minor axis, with an upper peripheral portion and a lower peripheral portion defining an elliptical plane, the upper peripheral portion of the second elliptical annulus being fixedly mounted to the lower peripheral portion of the first elliptical annulus with the minor axis of the first and second elliptical annulus being substantially in alignment, the major axis of the first and second elliptical annulus being substantially parallel, the lower portion of the second elliptical annulus having an outer surface for engaging the utility surface.

In a still further aspect, an exercise device for bouncing a user carried by the device from a utility surface, comprises a spring having a peripheral annulus for bouncing a user off the utility surface engaged by the annulus upon the flexing of the annulus in response to a jumping motion of the user; a stabilizing member having one end fixedly mounted to the annulus and laterally offset therefrom, the stabilizing member being slidably mounted to the annulus substantially diametrically opposed to the one end of the stabilizing member and offset from the annulus to provide symmetry of flexure of the spring during jumping; and a handle mounted to the annulus during jumping motion.

The accompanying drawings which are incorporated in and constitute a part of this specification illustrate several embodiments of the invention and, together with the description serve to explain the principles of the invention.

BRIEF DESCRIPTION OF THE DRAWINGS

FIG. 14(*b*) is a front elevational view of the device of FIG. 14(*a*);

FIGS. 15(*c*) and 15(*d*), illustrate diagrammatically the load being rebound elastomer mounted to the annulus of the device of the present invention with the foot support within the periphery of the annulus;

FIG. 25 is a fragmentary front elevation of an exercise device in accordance with a seventh embodiment of the present invention;

FIG. 26 is a front view of an arcuate segment used in the embodiment of FIG. 25;

FIG. 27 is a fragmentary sectional view illustrating the manner of connecting opposite ends of the arcuate spring of the device of FIG. 25;

FIG. 28 and FIG. 29 are members for connecting the elongate member to diametrically opposite locations of the annular spring of the embodiment of FIG. 25

FIG. 30 is a front elevational view of a exercise device in accordance with an eighth embodiment of the present invention;

FIG. 31 is an end view illustrating a removable handle for the exercise device of FIG. 30;

FIG. 32 illustrates the bracket used in connecting the hoop assembly to the elongate member when the optional handle of FIG. 31 is not used;

FIG. 33 is a fragmentary sectional view for showing the manner in which opposite ends of the arcuate segments of FIG. 30 are connected;

FIG. 34 illustrates i perspective the member for connecting the segments of the device of FIG. 30;

FIG. 49(*b*) shows a clamp for supporting the handle in the embodiments of FIG. 47 and 48;

FIG. 49(*c*) shows an exploded view of the clamp assembly of FIGS. 47 and 48;

FIG. 49(*d*) shows an exploded view of the clamp fixing for fastening the stabilizer bar to the base of the annulus;

FIG. 50(*b*) and 50(*c*) show a modification of the clamp slidably supporting the stabilizing bar;

FIG. 50(*d*) illustrates a front view of the eleventh embodiment of FIG. 50(*a*);

FIG. 51(*a*) shows a side view of the embodiment of FIG. 50 illustrating a modified clamp assembly for guiding the stabilizer member;

FIG. 51(*b*) is a fragmentary top view of the embodiment of FIG. 51(*a*) without the stabilizing member;

FIG. 52 shows a front view of an eleventh embodiment having a modified offset stabilizing member and clamp assembly;

FIG. 53 is a side view of the embodiment of FIG. 52; and

FIG. 54(*a*) and 54(*b*) shows a front and side view of the stabilizing member.

DESCRIPTION OF THE PREFERRED EMBODIMENTS

Figure 2:
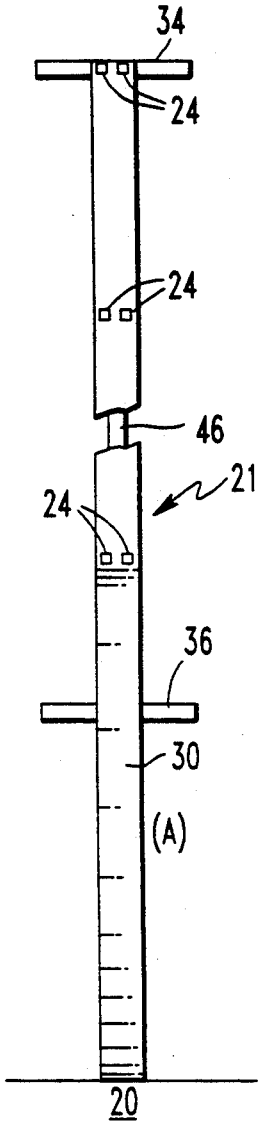
FIG. 2 is a fragmentary side view of the exercise device of FIG. 1 embodiment.

Reference will now be made in detail to the present preferred embodiments of the invention, examples of which are illustrated in the accompanying drawings wherein like reference numerals refer to like parts throughout the drawings.

Figure 1:
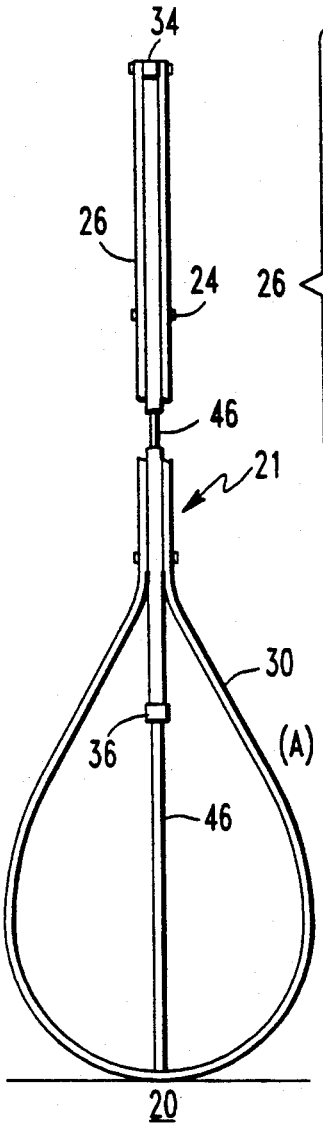
FIG. 1 is a fragmentary front elevation of an exercise device in accordance with one embodiment of the present invention.
Figure 5:
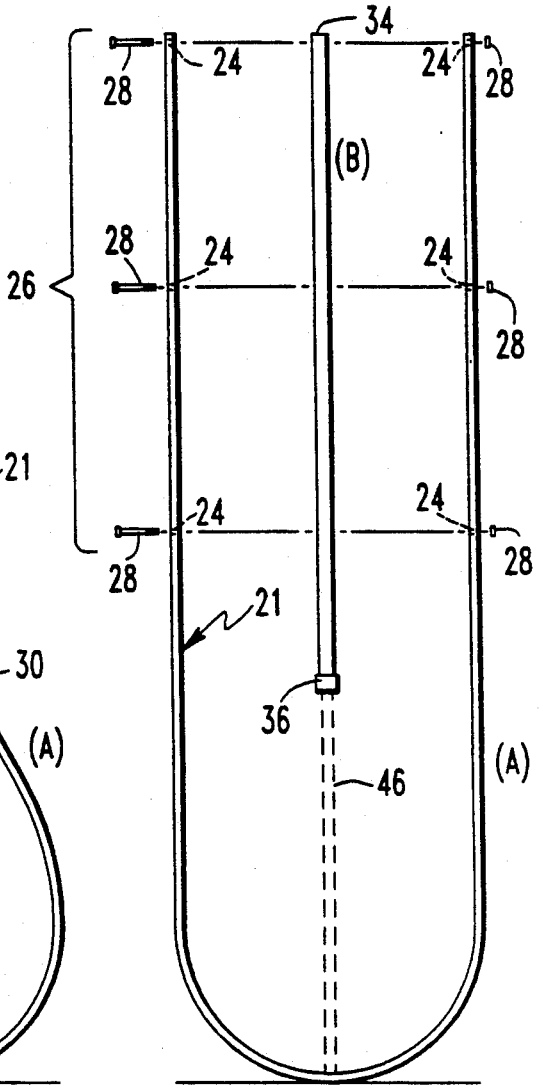
FIG. 5 is an exploded view illustrating an elongate resilient member in an unstressed state, and the manner of assembly to the member of FIG. 4 for constructing the device of FIGS. 1 and 2.
Figure 3A:
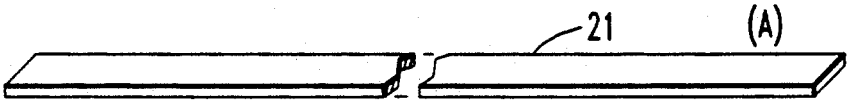
FIGS. 3(*a*) and 3(*b*) illustrate elongate resilient members in respective unstressed states used in making the exercise device of FIG. 1.
Figure 3B:
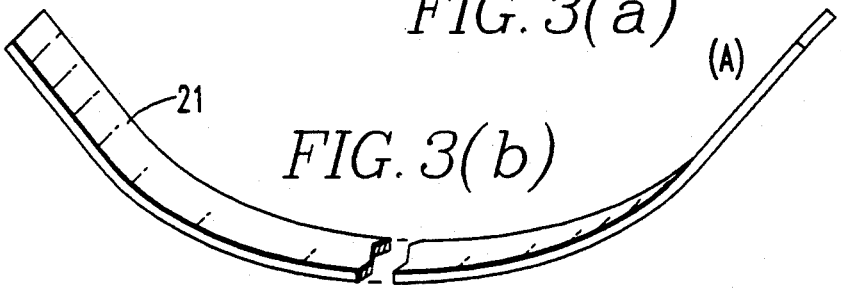

Referring to FIGS. 1 and 2, an exercise device for bouncing a user carried by the device from a utility surface according to one embodiment of the invention is generally referred to at 20. In accordance with the invention, the exercise device 20 comprises an annular resilient spring means having a peripheral annulus of a selected diameter, radial thickness, and axially extending width for bouncing a user within a predetermined weight range off the utility surface engaged by the annular member upon the flexing of the annulus in response to a jumping motion of the user. As herein embodied and referring to FIGS. 3A and 3B, the device 20 is made from an elongate resilient member 21, which may be linear in its relaxed state as shown in FIG. 3A, arcuate in its relaxed state as shown in FIG. 3B, U-shaped in its relaxed state as shown in FIG. 5, or arcuate in the relaxed shape, such as shown in FIG. 26, for example.

Member 21, may be made of metal, such as spring steel or may be made of a polymer composite, such as a fiber reinforced plastic matrix of a selected thickness, and width. The fiber may be composed of fiberglass, aramid, carbon, or graphite; and the plastic matrix may be of the thermosetting type or the thermoplastic type. If of the thermosetting type the plastic matrix may be selected from the group including epoxy, polyester, vinylester, phenolic, and polyurethane. If of the thermoplastic type, the matrix may be of the group including ABS, PVC, acrylic, polyamide, polycarbonate, thermoplastic polyester, polyethyelene, polystyrene and polysulfone. Preferably, the fiber is fiberglass and the plastic matrix is epoxy or vinylester.

Figure 4:
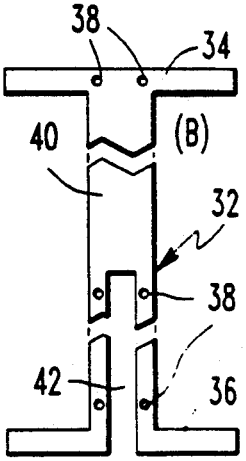
FIG. 4 is a unitary support member to which members of FIG. 3(*a*) or 3(*b*) are attached to form the exercise device of the embodiment of FIGS. 1 and 2.

In accordance with the invention, means are provided for connecting opposite ends of the resilient member in juxtaposition forming an annulus with a supporting portion. As herein embodied, member 21 has a plurality of longitudinally spaced holes 24 throughout a portion of the length of member 21 adjacent opposite ends referred to as lengths 26 herein. Threaded nuts and bolts 28 are inserted in the aligned holes and tightened to draw the corresponding surface of elongate member 21 in close opposition to one another. When member 21 is in a U-shaped configuration, either stressed or unstressed, holes 24 are aligned as exemplified in FIG. 4; and lengths 26 of member 21 are brought toward one another and connected by nuts and bolts 28.

Although it is contemplated that for certain usage opposing lengths 26 could be fastened directly in contact with one another to provide a tear drop shaped annulus 30 in accordance with the invention. The illustrated embodiment discloses a supporting member 32 having a handle 34 at one end and a foot support 36 adjacent the other end. Supporting member 32 is tightly sandwiched between opposing surfaces of lengths 26, bolts 28 are inserted through aligned holes 38 and 26 with nuts screwed up tight, providing a tear drop-annulus 30. Supporting member 32 may be of any strong material, such as wood, plastic, or light metal, for example. Handles 34 and foot support 36 may be either attached to shank portion 40 of member 32 or a portion of unitary piece 32. The portions or lengths 26 extending inwardly from opposite ends of the elongate piece 22 enclose a recess 42 that extends axially for a portion of the length of shank 40 of member 32 to form a bore. The device of the present invention includes a linear stabilizing bar 46 telescopically mounted in the bore formed by enclosed recess 42 and fixedly attached to tear-drop shaped annulus 30 coaxially of member 32. The outer width or diameter of bar 46 and the inner width or diameter of recess 42 are dimensioned so that member 32 and 46 slide easily relative to one another longitudinally with minimal lateral tolerance. The stabilizing bar maintains effective symmetry of flexure during use by reciprocating in the bore axially during flexure and rebound while still maintaining vertical alignment of the annulus.

Figure 6:
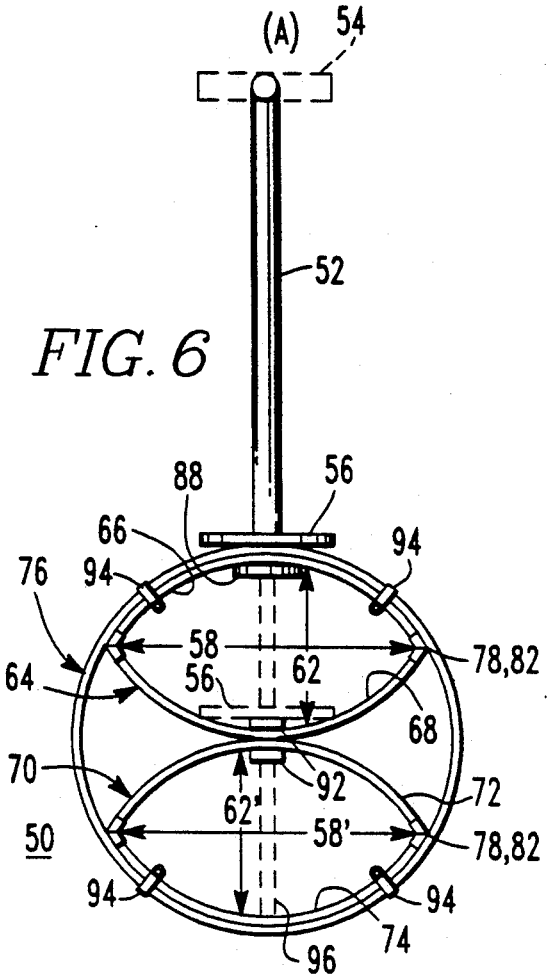
FIG. 6 is a side view in elevation of a second embodiment of the present invention.
Figure 7:
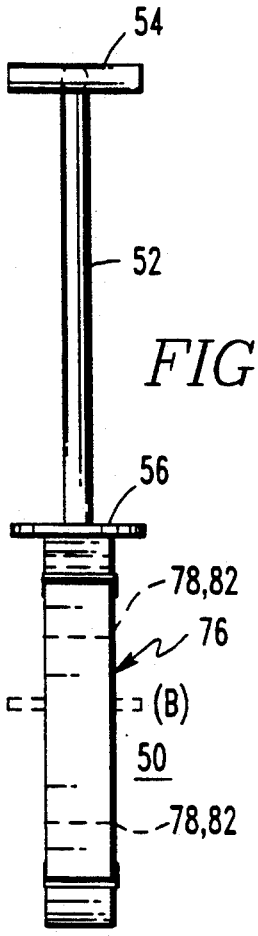
FIG. 7 is a front elevational view of the embodiment of FIG. 6.
Figure 9:
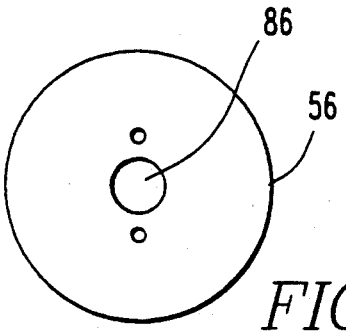
FIGS. 9 and 10 are plan views of a foot support for device of FIGS. 6 and 7.
Figure 10:
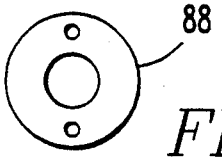
Figure 11:
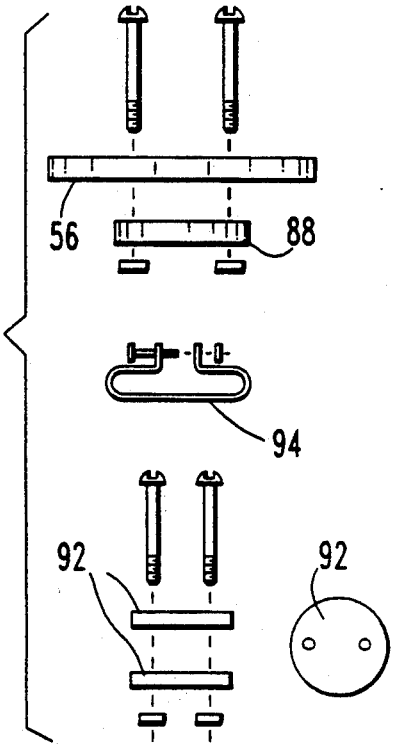
FIG. 11 are exploded views illustrating the manner of connecting the individual parts of FIGS. 6 and 7.
Figure 12:
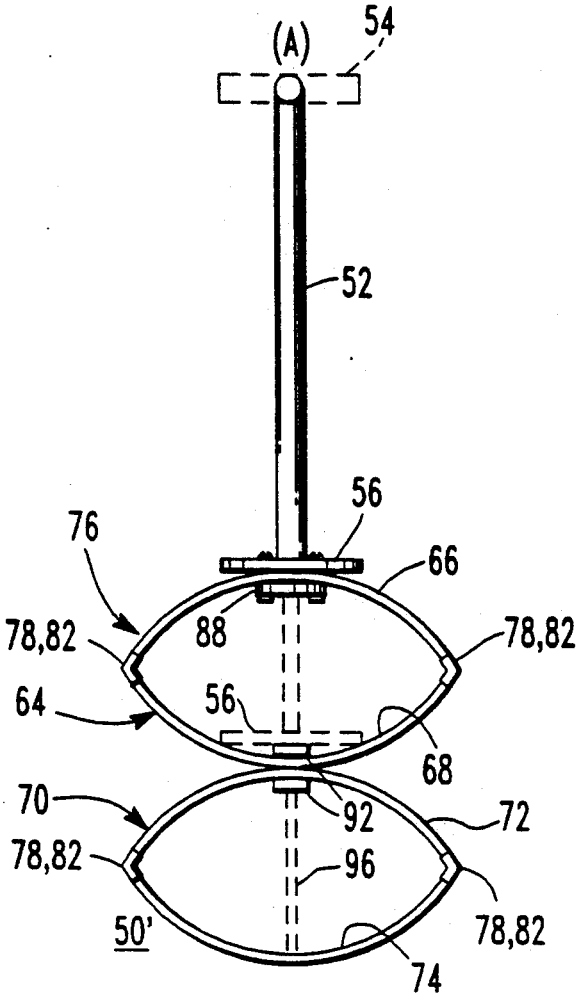
FIG. 12 is a side view in elevation of the second embodiment of the present invention without the outer circular annulus.
Figure 13:
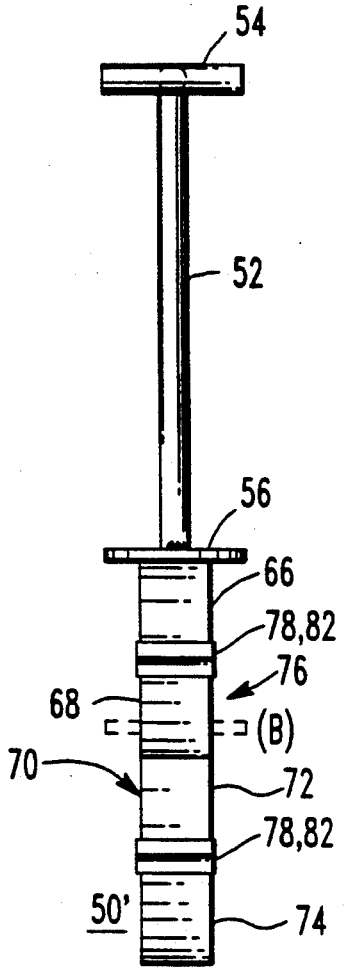
FIG. 13 is a front elevational view of the device of FIG. 12.

In the embodiments of FIGS. 6 through 13, an exercise device referred to as 50 in FIGS. 6 and 7 and 50' in FIGS. 12 and 13 comprises a member 52 having opposite ends defining a longitudinal axis therebetween with a hand grip 54 adjacent one end and a foot support 56 longitudinally spaced from the hand grip. Preferably, hand grip 54 is mounted to be adjustably rotated ninety degrees if desired for versatility of orientation.

In accordance with the present invention, device 50 comprises a spring means having a first annulus and a second annulus. As herein embodied, the first annulus of resilient material is elliptical on configuration and has a major axis as shown by arrow 58 and a minor axis as shown by arrow 62. Annulus 64 also has an upper peripheral portion 66 and a lower peripheral portion 68 defining a first plane. Elliptical annulus 64 is fixedly mounted at the upper peripherical portion 66 to member 52 adjacent an opposite end spaced from the handle. A longitudinal axis of member 52 extends substantially normal to major axis 58 in the plane. The spring means also includes a second annulus 70, which is similar to the first elliptical annulus as herein embodied, and has a major axis 58' and a minor axis 62'. Annulus 70 has an upper peripheral portion 72 and a lower peripheral portion 74 defining a second elliptical plane coplanar with the first elliptical plane. Upper peripheral portion 72 of annulus 70 is fixedly mounted to lower peripheral portion 68 of elliptical annulus 74 so that minor axis 62, 62' of both elliptical members are in the same plane one atop the other.

As shown in the embodiment of FIGS. 6 and 7 a circular resilient annulus 76 having an inside diameter corresponding to the combined lengths of the minor axes 62 and 62' of elliptical annulus 64 and 70 encloses the two elliptical annuli. This outer annular member may also provide a portion of the energy required for bouncing the device. Arcuate peripheral members 66, 68, 72 and 74 may be selected to provide all the required energy, if desired, or merely increase the permitted weight range. The two elliptical assemblies mounted one atop the other, as illustrated and described herein, serve as their own stabilizer, rendering an additional stabilizing assembly, such as a telescoping bar, unnecessary. If desired, circular annulus 76 can be omitted as shown in FIGS. 12 and 13. In this embodiment, the two elliptical annuli not only provide all of the required spring force or energy but the stabilizing requirement as well.

Figure 8A:
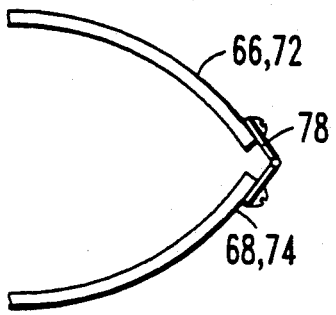
FIGS. 8(*a*), 8(*b*), and 8(*c*) are fragmentary illustrations depicting the manner of assembling the elliptical annular spring means used in the device of FIGS. 6 and 7.
Figure 8C:
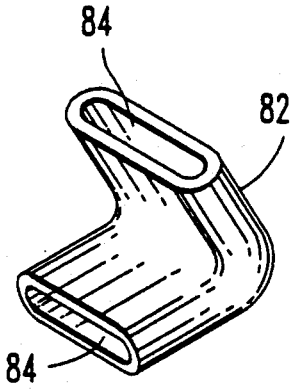
Figure 8B:
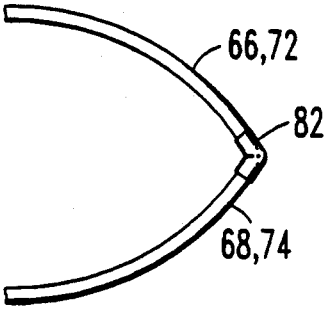

In assembling the embodiments of FIGS. 6, 7, 12 and 13, each of the elliptical annuli are preferably configured by joining suitable hinges two arcuate segments with suitable define the major axis of each ellipse. As shown in FIG. 8(*a*), a conventional plastic or metal door type hinge 78 may be fastened to the upper and lower peripheral portions by suitable screws or nuts and bolts; or as shown in FIGS. 8(*b*) and 8(*c*) a flexible plastic or elastomer hinge 82 may be used. Hinge 82 preferably has slots 84 in each arm for receiving and securing ends of the upper and lower peripheral portions of the resilient members.

In assembling device 50, the end of member 52 opposite the handle is inserted through a central hole 86 in foot support 56 and through a suitable opening in circular annulus 76 and the upper peripheral portion 66 of elliptical annulus 64. A washer like member 88 is slipped over the end of member 62 and bolted to foot support 56 with the spring 76 and segment 66 sandwiched in between. Device 50' is similarly constructed except that the outer circular annulus 76 is omitted. Member 52 may be threaded to foot support 56 and member 88 or otherwise rigidly secured to the elliptical and/or circular annuli, as the case may be. Foot support 56 is preferably disc-shaped so that a user may orient the plane of the annular spring at any desired angle to conform to the orientation of the handle.

Lower peripheral portion 68 of one elliptical annulus 64 is secured to upper peripheral portion 72 of annulus 70 by washers 92 bolted tightly together with the respective upper and lower peripheral members tightly sandwiched in between.

In the device 50 of FIGS. 6 and 7, outer annular circular spring 76 is attached to the upper and lower peripheral portions of elliptical annuli 64 and 70 by clamps 94.

Although the embodiments of FIGS. 6 and 7, and 12 and 13 do not require a stabilizing assembly for most uses other than the connected pair of elliptical annuli, a stabilizing bar 96 shown in dashed lines may be telescopically mounted to member 52 and extending through the adjoining respective upper and lower attached peripheral portions 68 and 72 and fixedly mounted to the lower peripheral portion of elliptical annulus 74. Also, in such event, foot support 76 may be mounted to an extension hollow of member 52 or within the periphery of the upper elliptical annulus.

Figure 14B:
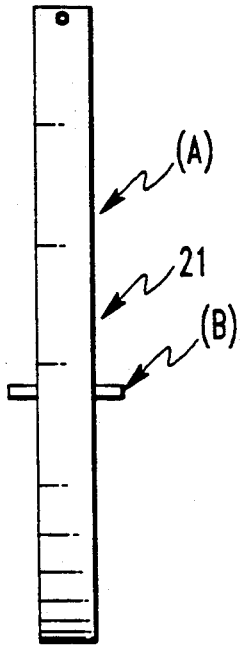
FIG. 14(*a*) is a side view in elevation of a device that is a modification of the embodiment of the invention illustrating a U-shaped spring.
Figure 14A:
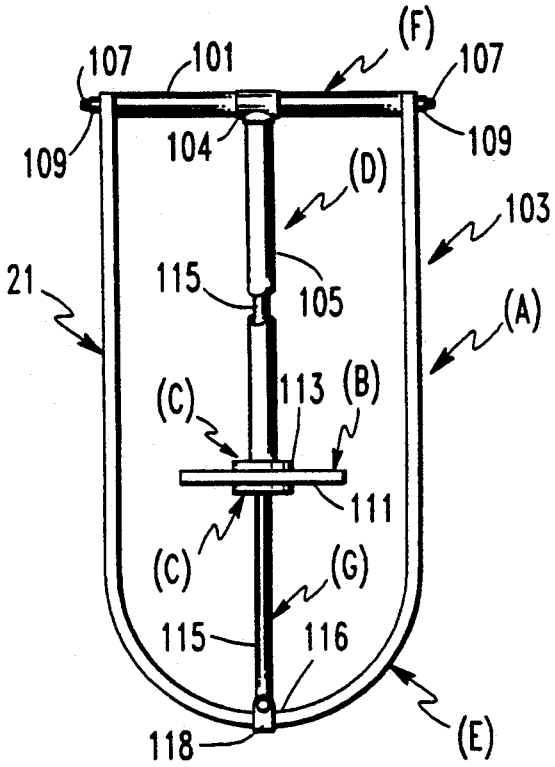
Figure 15A:
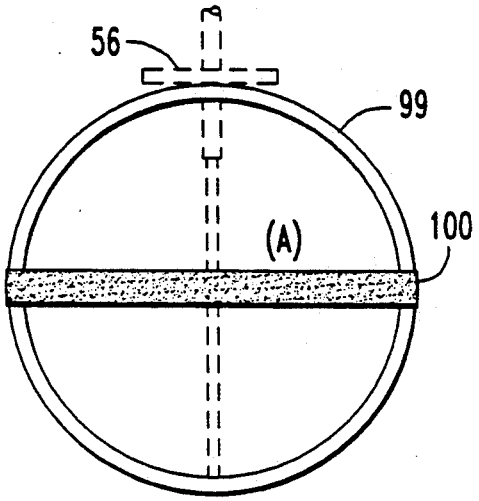
FIGS. 15(*a*) and 15(*b*) illustrate diagrammatically a load bearing rebound elastomer mounted to the annulus of the device of the present invention having a foot support on the periphery of the annulus.
Figure 15C:
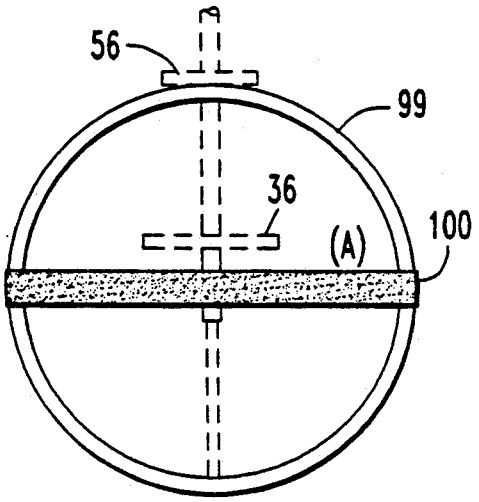
Figure 15B:
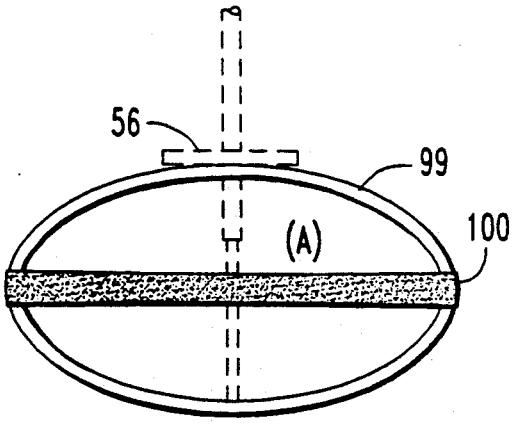
Figure 15D:
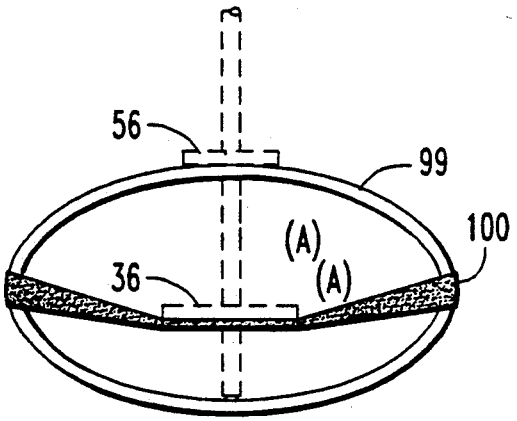

As embodied in FIGS. 14(*a*) and 14(*b*), an elongate resilient member, such as member 21 described in connection with FIGS. 3(*a*) and 3(*b*) is used in forming an annulus. Such elongate member may be normally, linear, arcuate, or U-shaped in an unstressed state. As shown in FIG. 14(*b*), member 21, if not already U-shaped in an unstressed state, is bent into such shape, and connected at opposite ends by means that includes a supporting portion 101 to form an annulus 103. The resilient portion of the annulus, which may be either plastic or spring steel, is U-shaped in configuration; and supporting portion 101, which may be constructed of light metal, plastic, or wood is linear in configuration. Member 101 may be tubular with a T-connection 104 midway between its ends to receive an elongate hollow member 105 which extends normal to the axis of linear member 101. Members 101, 104, and 105 may be a single unitary piece, or threadably connected to one another, or otherwise conventionally connected. Member 101 has threaded portions 107 extending axially out of opposite ends which extend through appropriate holes adjacent opposite free ends of member 21. Suitably threaded nuts 109 are threadably secured on projections 107.

Projections 107 may be opposite ends of a long rod that extends through a central bore of member 101 or threaded members conventionally fastened at opposite ends of member 101. Member 101 may also be suitably secured to member 21 by external threads opposite ends of member 21. A lower end of member 105 as view in FIG. 14(*a*) is threaded externally, and a foot support 111 is attached to the hollow member 105 between threaded washer type nuts 113. Washer type nuts may also be either glued or fused to member 105 depending on the material. Foot support 111 is preferably a rigid plate with a central opening for receiving the member 105; and is dimensional for effectively supporting the feet of a user. Foot support 111 may be of various configurations, and may be fixedly attached to rod 105 or form part of a unitary piece with elongate member 105. A stabilizing bar 115 is telescopically attached t member 105 and fixedly attached centrally of bight portion 116 of U-shaped member 21 by a U-shaped clamp 118 that tightly grips member 21.

Referring to FIGS. 15(*a*), 15(*b*), 15(*c*), and 15(*d*), a hoop 99 is shown schematically, which is intended to represent the annular resilient means of the several embodiments herein, has an elastomer band 100 encircling the periphery of a respective spring, and extends substantially parallel to the utility surface upon which the device is used. Elastomer band 100 is of such dimension to be slightly under tension when mounted on hoop 99 in the relaxed shape. The elastomer band is preferably at least of the strength and elasticity of a vehicle inner tube. A device of the present invention that utilizes an elastomer band has the advantage of providing an energy source that complements and supplements the performance of the device. As hoop 99 is compressed in response to the jumping motion of the user, elastomer band 100 operates according to what may be termed the "slingshot" principle as it expands and contracts. It is contemplated that one or more elastomer bands 100, of selected widths may be used to enhance the movement of the device depending on the weight of the user. Elastomer band 100 also tends to relieve stress when the hoop assumes an elliptical shape under the jumping weight of the user as shown in FIGS. 14(*b*) and 15(*b*).

For applications where a foot support such as 36 is within the periphery of the annulus as shown in FIGS. 15(*c*) and 15(*d*), the elastomer band 100 may engage the foot rest during operation, which will also assist the propelling of the user upwardly. For this application, the elastomer band may be fastened to the hoop to prevent it from being forced off the hoop during operation.

Figure 16:
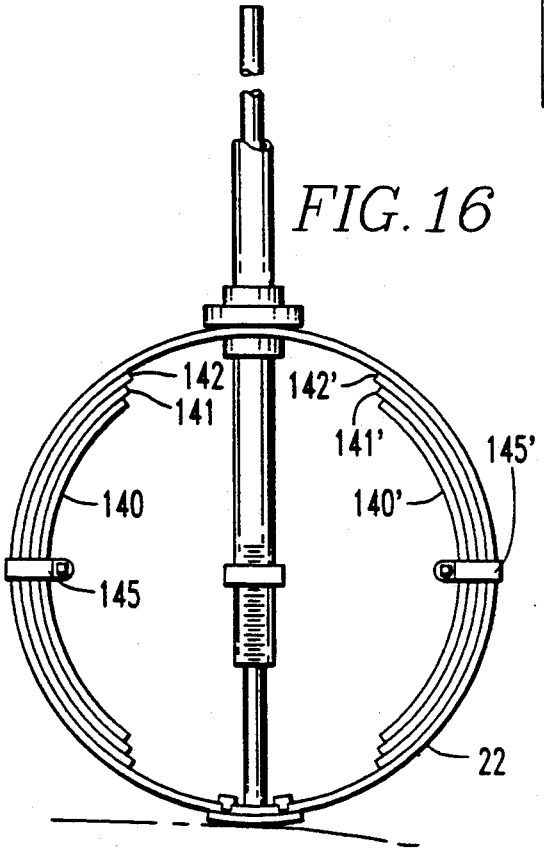
FIG. 16 is a front elevational view of an exercise device in accordance with a fourth embodiment of the present invention illustrating arcuate piggy-backed spring segments attached to the inner surface of the annular spring means.
Figure 17:
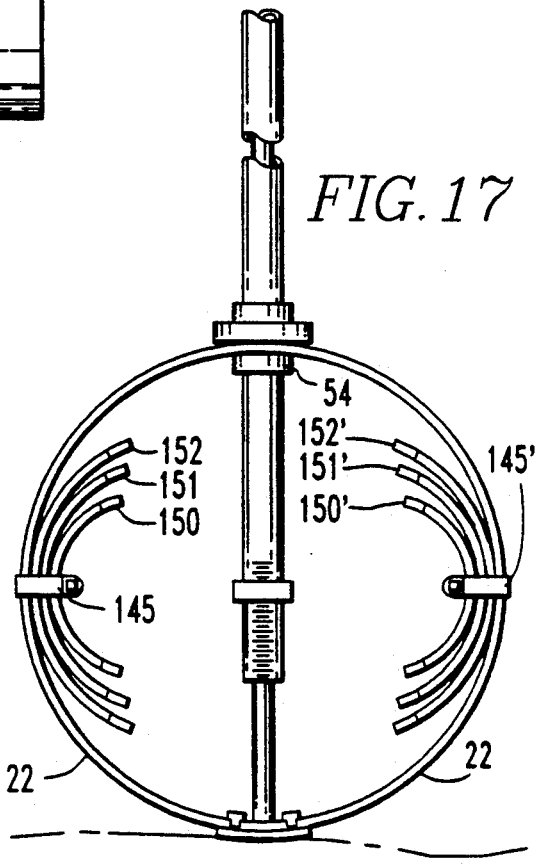
FIG. 17 is a front elevational view of an exercise device in accordance with a fifth embodiment of the present invention illustrating piggy-backed arcuate segments having a radius less than the radius of the hoop.

Referring to the embodiments of FIG. 16 and FIG. 17 wherein the exercise device of the present invention is further modified to provide user adjustable ranges of stored energy, the embodiments of FIG. 16 and FIG. 17 further comprise a weight adjusting means for controlling the energy ranges in a progressive and a reserved manner. As embodied herein and referring to FIG. 16(*a*), hoop 22 has attached to the inner surface thereof a plurality of resilient segments 140, 141 and 142, which are aligned and stacked in the same plane as hoop 22 and disposed in physical engagement throughout their length to the inner surface of hoop 22 and to each other.

Figure 43:
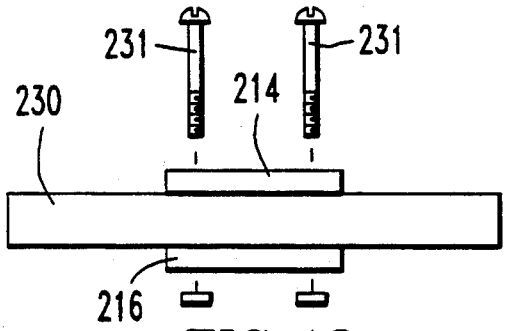
FIG. 43 illustrates a birds eye view of a hand grip for the device of FIG. 35 and FIG. 36.

In accordance with the invention, fastening means are provided for selectively positioning the weight adjusting means to a plurality of different positions in the inner surface of the hoop 22. (See FIG. 43(*a*)–(*i*) hereafter described). As embodied herein, a bracket 145 embraces stacked hoops such as 141, 142 and hoop 22. As shown in FIG. 14, a threaded bolt 146 and nut 148, for example, are provided to draw opposite ends of bracket 145 together to secure the spring segments into engagement with inner surface of hoop 22 at the desired angular position. Similarly, hoop segments 140, 141, and 142' are disposed in engagement with hoop 22 opposite the stacked segments 140 through 142. A bracket 145 selectively positions the latter referred to hoop segments in the same manner as the previously described hoop segments. In the embodiment of FIG. 16, it should be noted that each of the stacked hoop segments are in physical engagement with each other throughout their length and may be removably attached by more than a single bracket 145.

It is understood, that more or fewer than three segments, such as 140–142 for example, may be used, and with fastening means 145, the user is able to adjust a weight adjusting means to provide the desired compression and rebound to suit a personal preference. This is accomplished, by selecting the quantity of arcuate springs used; by selecting the stacked sequence of the lengths of the spring segments; and by selecting the angular location of the spring segments on hoop 22.

While the resilient segments reflected in FIG. 16 are shown attached to the inner surface of hoop 22, it should be noted that the resilient segments can also be attached to the outer surface of the hoop by locating a bracket 145 at each end of the segment and attaching to hoop 22.

In accordance with the invention, weight adjusting means are provided that progressively store reserve energy as the annulus is compressed. As embodied herein and referring to FIG. 17, arcuate segments 150, 151, and 152 are stacked with a point of engagement approximately midway between opposite ends thereof, and are fastened by fastener 145. As illustrated, each one of the segments 150, 151, and 152 have a radius that is smaller than the adjacent segment and the ends of the segments are spaced from one another when the exercise device is in a non-compressed condition. In this embodiment, as the hoop 22 becomes compressed each one of arcuate segments, such as 151 through 152 are progressively depressed. Opposite the segments 150, 151, 152 are similarly fastened and configured segments 15', 151', and 152' in the embodiment of FIG. 17, where each arcuate segment has a radius which is significantly less than the annulus, with each segment being less than the preceding segment. Attachment is made at a central point, and the energy of the spring segments 150 to 152 and 150' to 152' is in reserve, and used as the hoop 66 becomes more and more compressed. The reserved stored energy is released as the loading of the annular spring is released. Thus, the annular spring means engages the first spring segment such as 152 and 152'; then the first spring segment 152, 152' makes contact with the second spring segment 151, 151'; and finally, with the flexure of compression of hoop 22, 151, 151' make contact with segment 150, 150' respectively.

Figure 23:
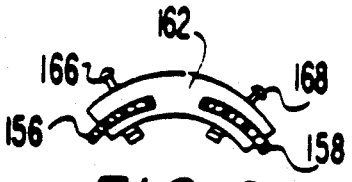
FIG. 23 is a fragmentary sectional view illustrating the manner in which the arcuate segments of FIG. 21 are connected.

In accordance with another embodiment of the present invention, the annular spring means is comprised of arcuate spring segments that are connected at opposite ends to form a resilient annulus. As herein embodied, and referring to FIG. 21, annular spring 154 is made up of an arcuate spring segment 156, and an arcuate spring segment 158. Each of the spring segments extend through an arc that is slightly less than 180°, such that ends of segments 156 and 158 are disposed opposite each other. Their corresponding opposite ends define a gap 160 and a gap 162 which are substantially diametrically opposed. Segments 156 and 158 are resiliently connected at opposite ends by a tubular member 162 (FIG. 22) that has a bore 164 with a diameter positioned to snugly receive opposite ends of arcuate spring segments 156 and 158. Member 162 is preferably a short piece of heavy duty hose that has the consistency and strength of reinforced nylon. The ends of segments 156 and 158 are inserted and fastened in bore 164 preferably by threaded nuts and bolts 166 and 168, respectively (see FIG. 23). The embodiment of FIG. 21 has certain advantages, in that the elongate member 33, 36 are able to be attached to the annulus by inserting them through an opening such as 170 in the tubular connecting member 162. Also, an arrangement such as shown in FIG. 21 can be packaged in a relatively small container and easily assembled by the purchaser.

Figure 21:
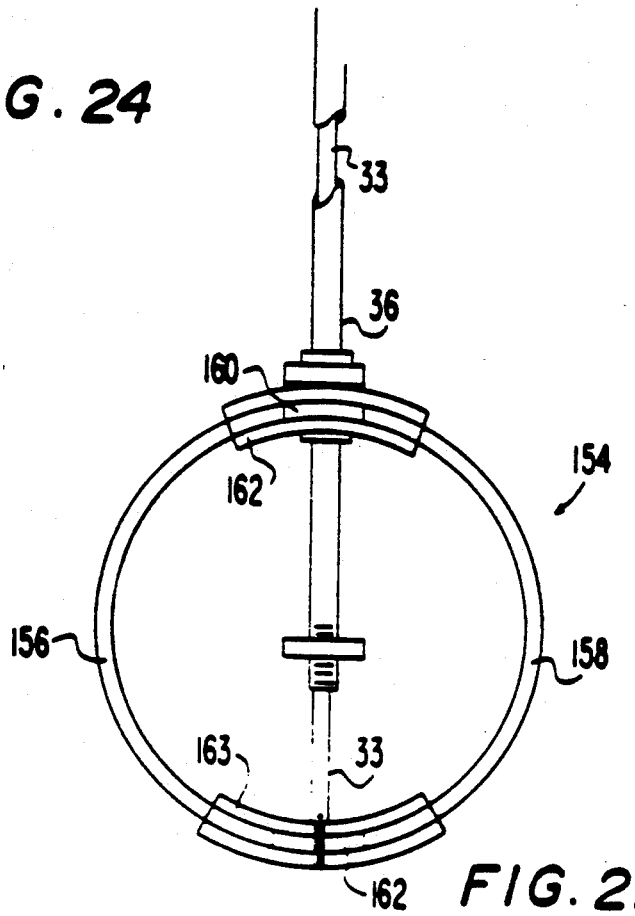
FIG. 21 is a front elevational view of an exercise device in accordance with a sixth embodiment of the present invention.

While FIG. 21 reflects a heavy duty hose as the means to connect spring segments 156 and 158, it should be noted that when the foot rest is located on top of the hoop (as it can be on all of the devices with the exception of FIG. 30) any suitable flexible material may be sandwiched between the footrest and bolted in the same manner as depicted in device 50.

In accordance with another embodiment of the invention, the annular spring means comprises a hoop that encloses an arcuate segment of slightly less than 360°. Referring to FIG. 25, and as herein embodied, annular spring means 172 is comprised of a unitary arcuate member 174 having opposing ends 176 and 168 that define a gap 180. In the embodiment of FIG. 25, annular spring means 172 is completed by connecting ends 176 and 178 together by a pair of heavy duty flexible columnar straps 182 (See FIGS. 27, 28, 29). Straps 182 may be fastened adjacent 176 and 178 of hoop 172 by threaded bolts 184. An insert 186 is inserted between straps 182 to substantially fill gap 180. It is also contemplated that a heavy duty hose connector such as 162, may be used in place of strap 182. Elongate member 36 is fastened to annular spring means 172 by inserting it through orifices 188 and 190 of straps 182 and 186. Also, the annular spring means may comprise a hoop that enclosed an arc greater than 360°. In this situation, ends 176 and 178 of spring 174 overlap, with member 36 being inserted through suitable aligned openings in the overlapping ends. Straps 182 and 186 are preferably made of a heavy duty polymer. Insert 186 can also be used for attaching and supporting the end of member 33 to hoop 174 where hoop 174 strikes the utility surface.

Figure 22:
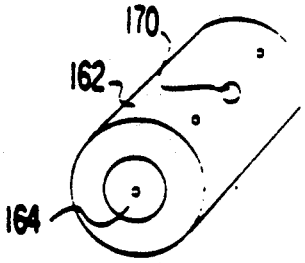
FIG. 22 is a perspective view of a component for connecting the arcuate segments of FIG. 21 to form the annular spring.

Referring to the embodiment of FIG. 30, annular spring means 154 is similar to the embodiment of FIG. 21, except that elongate telescoping means 192 and 194 terminate at opposite ends within the periphery of the spring means; and is fastened at opposite ends to connecting members 196 (See FIG. 34) which is similar to connecting member 163 of FIG. 22, except that it does not include a bore for inserting stabilizing bar 192 and 194 therethrough. Instead, a U-shaped strap 198 as shown in FIG. 32 is used to fasten elongate member 192 at one end to connecting member 196. The strap 198 is slipped over the member 197; and is secured by threaded nuts and bolts 199 to member 192. Similarly, a strap 198 embraces member 196 at the opposite end of annulus 154, where the annular spring means strikes the utility surface.

It is contemplated that in the embodiment of FIG. 30, a user may stand on foot support 60 and grasp connecting member 196 which would serve as a handle. However, if the user wishes to use a separate handle, a removable handle portion may be attached to one of the connecting members 196. Referring to FIG. 31, handle portion 200 may be made of any rugged material such as plastic, or metal. Member 200 includes a slot 202 having a width sufficient to slidably receive member 196 and stabilizing bar 92. Handle member 200 is fastened to bar 192 by threaded nuts and bolts 204. Members 196 may be slightly longer than connecting member 162 of the embodiment of FIG. 21 in there is a greater number of threaded nuts and bolts such as 206 used to fasten member 196 to opposite ends of arcuate segments 156 and 158.

Figure 19:
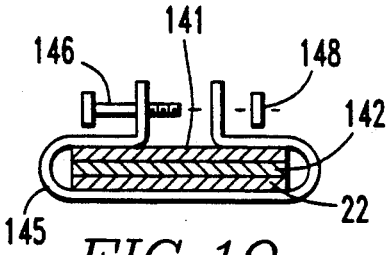
FIG. 19, is a cross-sectional view of a clamp for removably attaching the arcuate segments to the inner surface of the annular spring.
Figure 18:
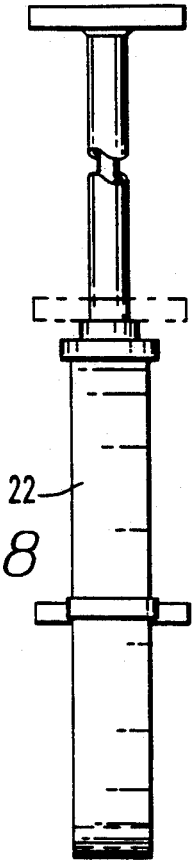
FIG. 18 is an elevational side view of the fourth and fifth embodiments.
Figure 20:
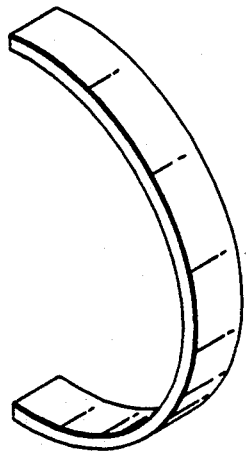
FIG. 20 is a perspective view of an individual metallic or non-metallic arcuate segment used in the embodiments of FIGS. 16 and 17.
Figure 24:
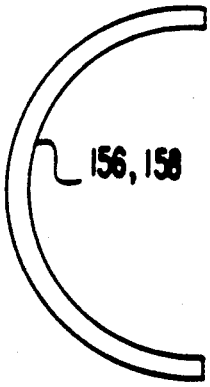
FIG. 24 illustrates an individual arcuate segment used in the embodiment shown in FIG. 21.
Figure 35:
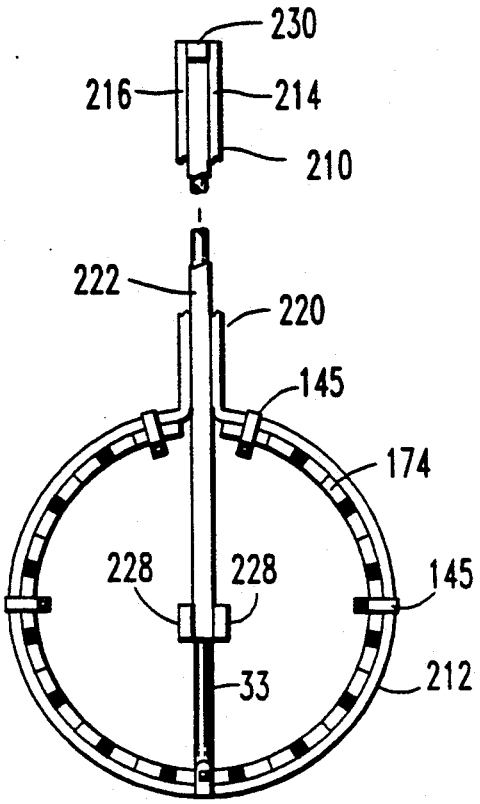
FIG. 35 is a front elevational view of a ninth embodiment of the present invention.
Figure 37:
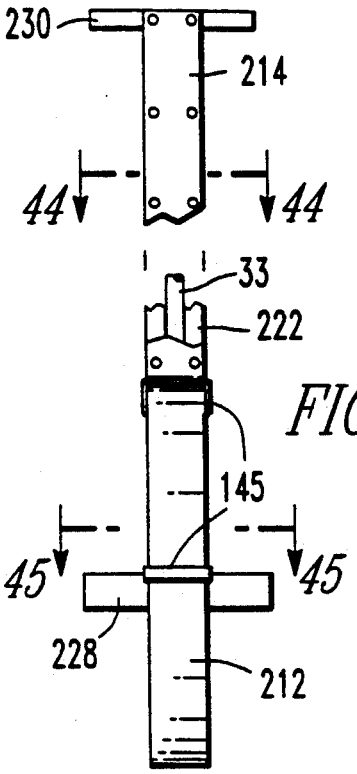
FIG. 37 is an elevational view of the embodiments of FIG. 35 and FIG. 36.
Figure 36:
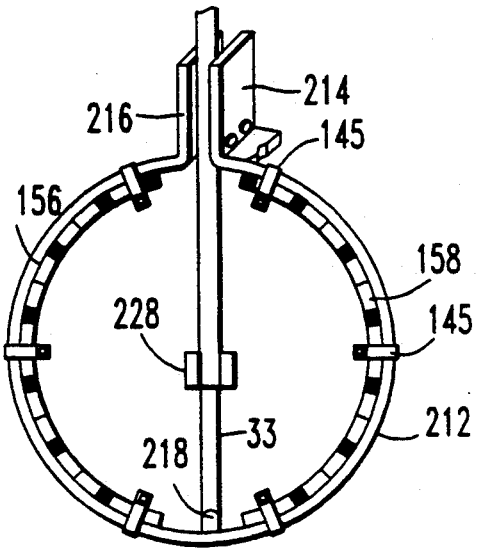
FIG. 36 is a fragmentary front elevational view illustrating a modification of the embodiment of FIG. 35.
Figure 44:
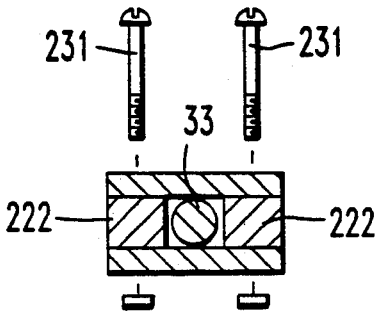
FIG. 44 is a sectional view taken at line 44–44 of FIG. 37 showing the assembly of the elongate member.
Figure 45:
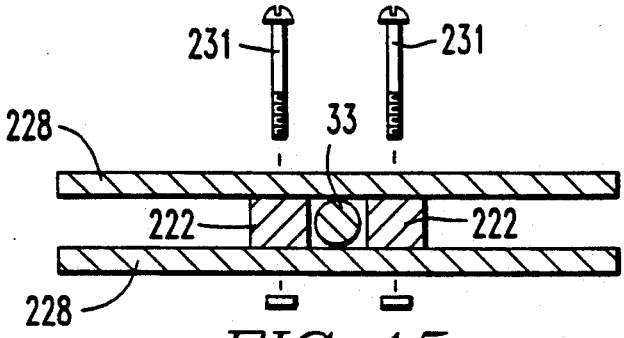
FIG. 45 is a sectional view taken at line 45–45 and looking in the direction of the arrows illustrating the footrest assembly for the embodiments of FIGS. 35 and 36.
Figure 42:
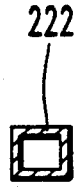
FIG. 42 is a sectional view of an alternate embodiment of the bar of FIG. 40.
Figure 38:
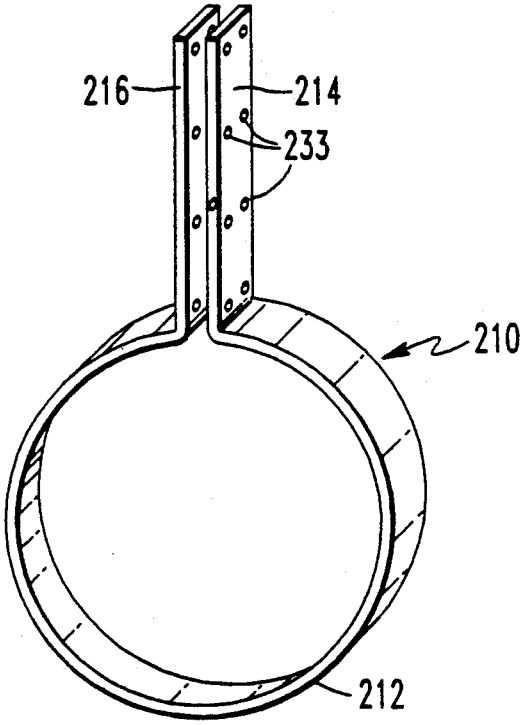
FIG. 38 is a view in perspective of the one piece housing for supporting the arcuate segments in the embodiment of FIG. 35 and FIG. 36.
Figure 39:
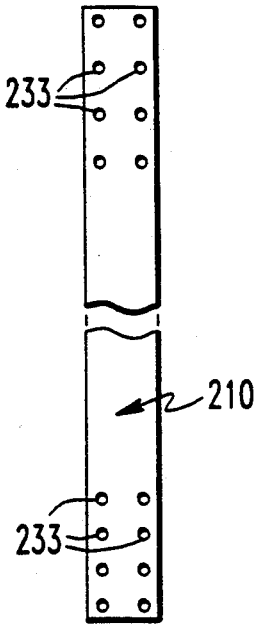
FIG. 39 is an elevational view of a member from which the housing of FIG. 38 can be made.
Figure 40:
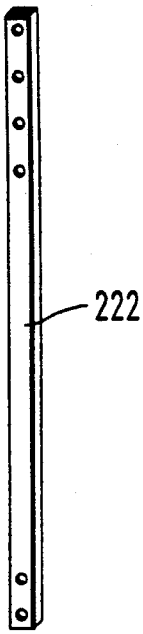
FIG. 40 is a perspective view of a bar used in fabricating the elongate portion of the embodiments of FIGS. 35 and 36.
Figure 41:
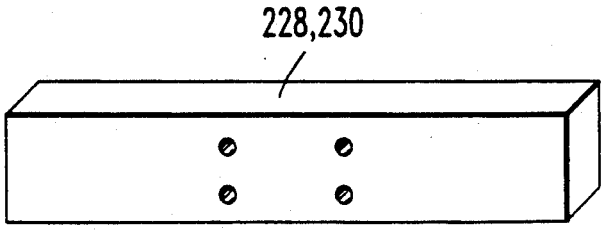
FIG. 41 is a member from which foot supports and a handle may be made for the device of FIGS. 35 and 36.
Figure 46A:
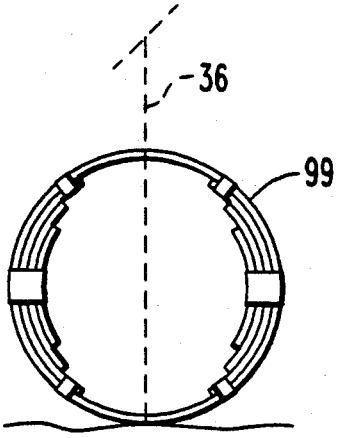
FIG. 46(*a*)–(*h*) illustrate various arrangements for connecting the user adjustable multi-variable load bearing rebound arcuate spring segments for various annular spring assemblies.
Figure 46B:
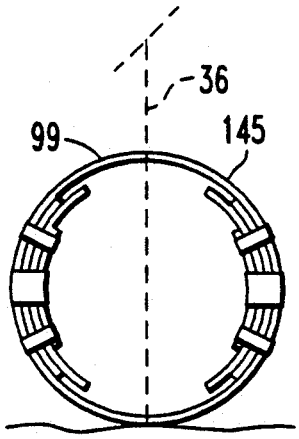
Figure 46C:
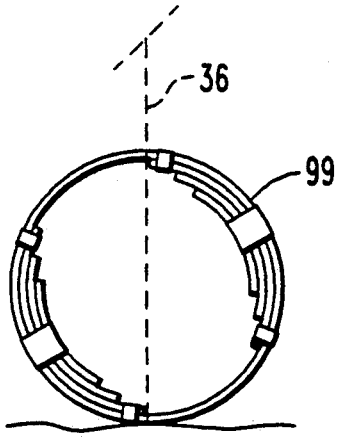
Figure 46D:
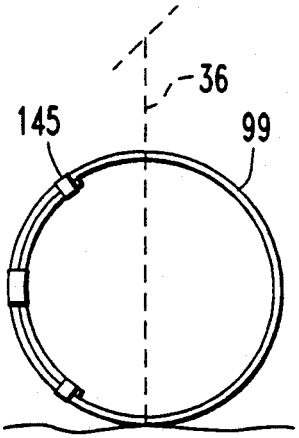
Figure 46E:
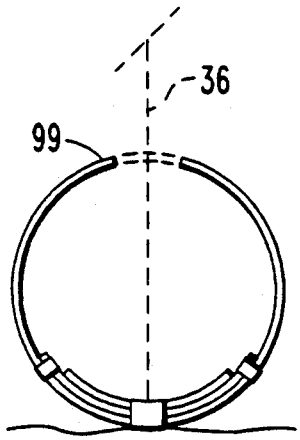
Figure 46F:
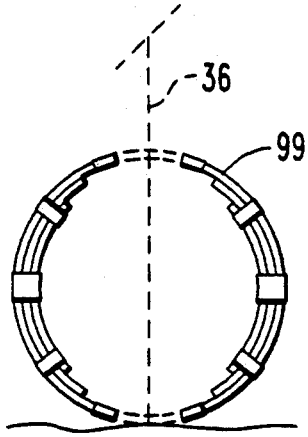
Figure 46G:
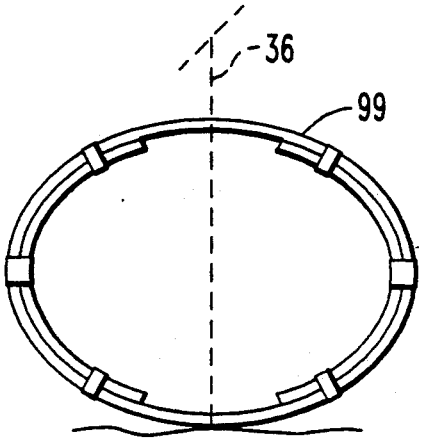
Figure 46H:
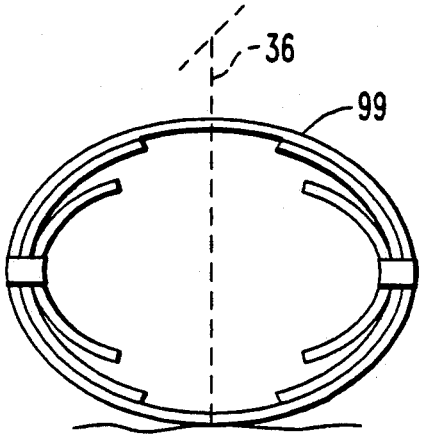

Referring to the embodiments of FIGS. 35 and 36, the annular resilient spring means includes a unitary housing 210, that is preferably made of a pliable polymer having a strength similar to that of nylon. Housing 210, which is preferably made of one strip such as shown in FIG. 39, may be bent to form a circular hoop portion 212 with opposite ends that oppose each other and extend radially outwardly, and which are referred to as flanges 214 and 216 respectively as shown in FIG. 38. Although, the housing 210 may have spring energy similar to the hoops and spring segments described in connection with the previous embodiments, it is contemplated that the portion 212 of the member is included mainly as a housing for the resilient spring means of the device. In this connection, if desired, it may even be metal or other material adding strength to the remainder of the device similar to FIGS. 16 and 17. In the embodiment of FIG. 35, an arcuate spring segment such as 174 (see FIG. 26) is fastened to the inner surface of portion 212 of the housing connecting members such as 145 (see FIG. 19) spaced at various angular positions about the periphery of portion 212. Referring to FIG. 36, arcuate segments such as 156 and 158 (see FIG. 24) are fastened by members 145 to opposite sides of housing portion 212, and are disposed to provide a gap diametrically opposed to the radially extending flange portions 214 and 216. A circular rod such as 33 is fastened to housing 212 by a threaded bolt such as 218. A stabilizing bar assembly 220 is constructed by fastening a pair spaced rigid rectangular bar portions 222 (FIG. 40) fastened between flange portions 214 and 216 to form a hollow frame work, for receiving rod portion 33 telescopically. At one end of the rectangular hollow assembly 220 is a pair of foot supports 228 (see FIG. 45). At the opposite end of hollow assembly 220 is a handle 230 (see FIG. 45). At the opposite end of hollow assembly 220 is a handle 230 (see FIG. 43). Suitable threaded nuts and bolts such as 231 fasten bars 222, handle 230, and foot supports 228 to radially extending flanges 214 and 216 via holes 233 to complete the exercise device. Foot support 228 and handle 230 may be made from the member shown in FIG. 41. The individual parts of the assembly 220 may be made of plastic or light metal such as aluminum.

Referring to FIG. 46, several arrangements of the weight adjusting means for the various preferred embodiments are illustrated schematically by way of example. As in FIGS. 14(*a*) and (*b*) and 15(*a*) and (*b*), for example, FIGS. 46(*a*) through 46(*h*) include hoop 99 which, where applicable, represents the various embodiments herein. For example, the hoop of 46(*a*) involves a unitary annular hoop with a plurality of arcuate segments in equal strength n opposite sides of elongate member 36 that are stacked, and are in engagement with each other through their length. Each one of the arcuate segments is arranged so that each segment is shorter than the adjoining one and in sequence. Referring to FIG. 46(*b*) the sequence of the stacked segments is different so that a longer segment is sandwiched between a medium length and shorter segment. This sequence gives a different bounce than the sequence of 46 (*a*). In 46(*c*) the sequence of the arcuate weight adjusting segments is the same as 46(*a*) except, they are positioned angularly off center so that the opposing weight adjusting stacks are located substantially in the northeast and southwest quadrants of the annulus respectively. This arrangement provides a stiffer bounce than the arrangement that is equidistant from opposite sides of the elongate member such as shown in FIG. 46(*a*) or 46(*b*). Referring to FIG. 46(*d*), the arcuate weight adjusting segment is fastened to the inner surface of the annular hoop on one side of the elongate stabilizing bar only. This arrangement loads only one side, so that a flexing of the annulus assists horizontal or in other words cross country motion of the device. FIG. 46(*e*) shown an arrangement where the weight adjusting segments are fastened to the bottom portion adjacent where spring means strikes the utility surface; FIG. 46(*f*) is similar to the arrangement of FIG. 46(*a*) except that the annular spring means is comprised of a pair of arcuate segments that are longer than the weight adjusting segments for forming the annulus. It should be noted that in the arrangement of FIG. 46(*e*), the downward force of the annular spring means opens the arc of the spring segments instead of compressing them. FIG. 46(*g*) illustrates an elliptical hoop 236 having weight adjusting segments the opposite ends of the major axis. FIG. 46(*h*) is similar to the embodiment of FIG. 17 except it is illustrated as an elliptical hoop.

Thus, it can be seen that with the benefit of the present invention, an exercise device is provided that is user adjustable in a multitude of ways for varying the spring action of the device. The characteristics of the device can be varied such that the bounce is either stiff or soft or it is stiffer on one side than the other, for creating a cross country motion during the operation of the device. The user can adjust the device for soft compression and stiff rebound, or stiff compression, and soft rebound. Of course, as previously mentioned, the device can be used for various individual weights of users depending upon the number of arcuate segments that are used. Also, an elastomer band may be stretched across the hoop not only to influence the weight factor, but also to provide additional energy on the rebound.

In operation, the devices are positioned upright as viewed in the drawings, and the user stands on the foot support and grasps the handle. With the handle securely grasped the user jumps slightly in the air to increase the downward force on the supports. This deforms the annulus and segments and weight adjusters, if so equipped. For a circular annulus an oval shape is assumed at the bottom of the users descent. The resiliency of the annular member cause it to assume its normal configuration propelling the device and the user off the ground or utility surface. With respect to the arcuate segments members, the jumping action causes the radius of the arc to decrease at the depth of descent and to spring back for propelling the user upwardly.

In accordance with the tenth embodiment of the present invention, the exercise device comprises a spring means having a peripheral annulus for bouncing a user off a utility surface engaged by the annulus upon the flexing of the annulus in response to a jumping motion of the user as described in connection with the previous embodiments.

Figure 47:
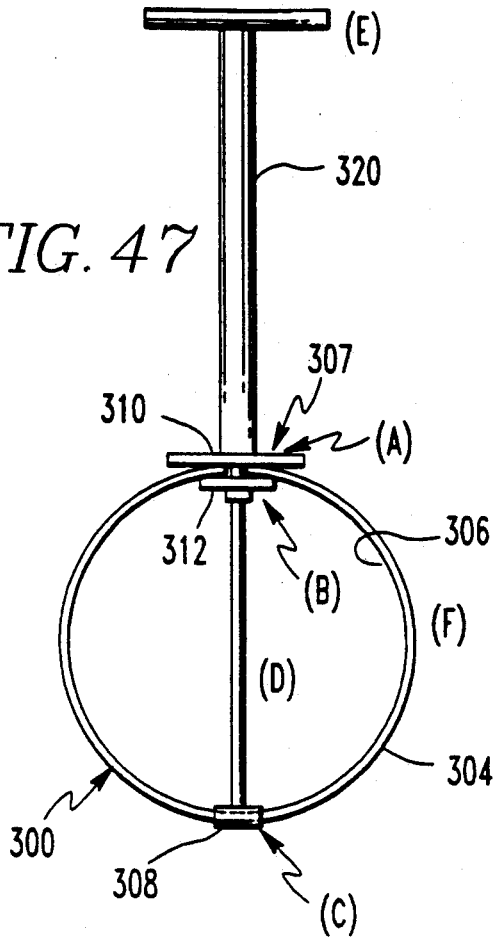
FIG. 47 is a front elevational view of a tenth embodiment of the present invention utilizing an offset stabilizing member, and handle.

As shown in FIG. 47 an annular spring 300 has an outer surface 304, which engages a utility surface, and an inner surface 306. The spring 300 may be metallic or non-metallic resilient material. A first clamp 307, which may be substantially U-shaped in configuration embraces the inner and outer surfaces 304 and 306 of the annulus and is configured to have a portion extend laterally alongside or beyond the annulus of the spring 300.

A second clamp, such as 308, which may be any substantially rigid metallic or non-metallic material is fastened to the annulus diametrically opposed to the clamp. As shown in the drawings, clamp 307 has an outer plate 310 and an inner plate 312 which are fastened together in engagement with outer surface 304 and inner surface 306 of the annulus, respectively, by nuts and bolts 314. Outer plate 310 may be configured to act as a foot support; and also, has a projection 316 that extends beyond the edge of annulus 300. Inner plate 312 of clamp 307 has a projection 318 that extends beyond the edge of the annulus and underlies projection 316 of outer plate 310. Projection 316 and 318, each have a hole formed therein which are in alignment with one another and into which nuts and bolts 314 are inserted to secure clamp 307 in position.

A stabilizing member has one end mounted to clamp 308 and is slidably contained by clamp 307 upon the flexing of the spring as shown in FIG. 49(*d*) clamp 308 is fastened to the annulus by a bolt or screw 311, which draws the arm portions of the clamp together. The screw or bolt 311 may also fasten one end of a stabilizing member 315. A handle 320, which may be hollow in configuration is secured to clamp 308 and fits telescopically to stabilizing member 315.

Thus, the stabilizing assembly which includes member 315 and handle 320 is offset from spring 300, which is advantageous in that, there is no drilling or cutting of the annulus required to attach either the stabilizing member to the handle or the annulus of the spring.

Figure 48:
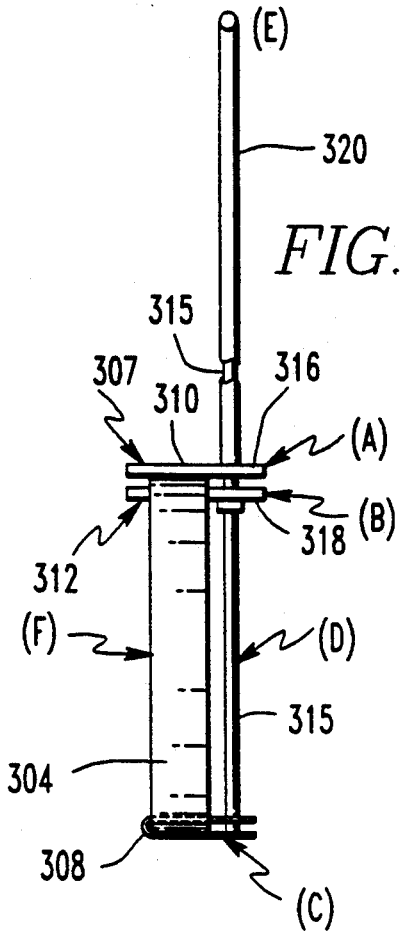
FIG. 48 is a side elevational view of the embodiment of FIG. 47.
Figure 49A:
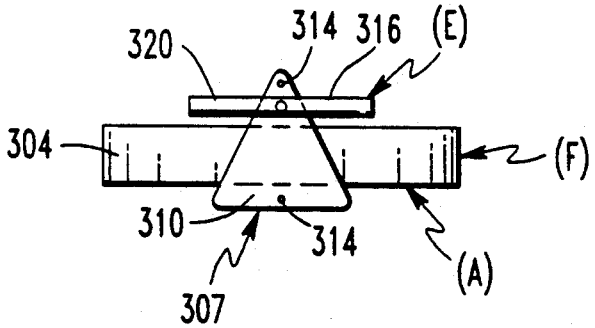
FIG. 49(*a*) is a fragmentary top view of the embodiments of FIGS. 47 and 48.
Figure 49D:
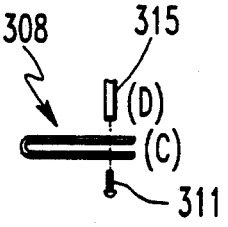
Figure 49B:
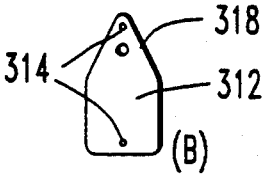
Figure 49C:
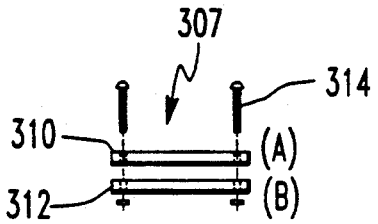
Figure 50D:
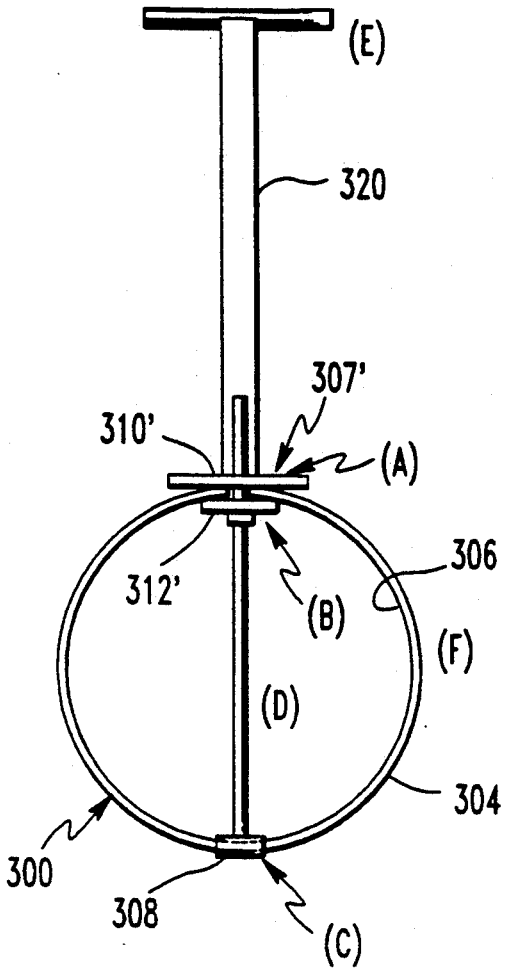
FIG. 50(*a*) illustrates a side view of an eleventh embodiment illustrating a stabilizer member offset from both the handle and the annulus.
Figure 50A:
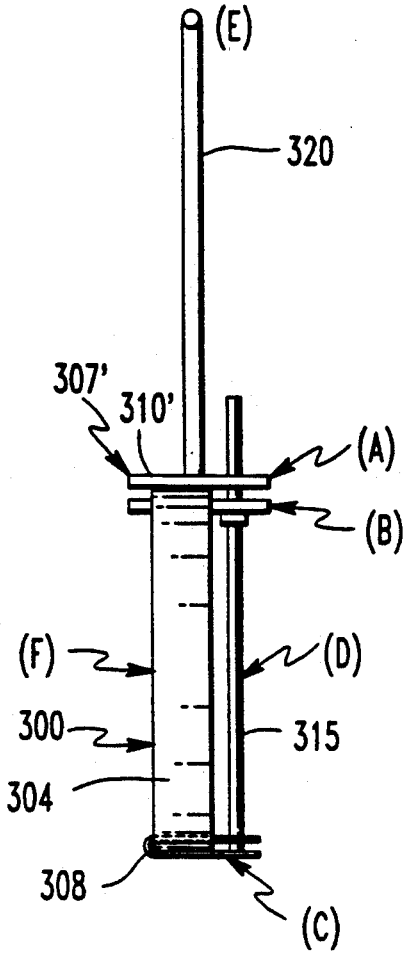
Figure 50B:
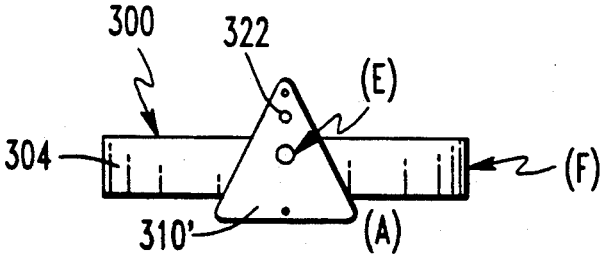
Figure 50C:
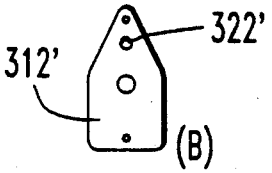

In the eleventh embodiment of the invention, as shown in FIG. 50(*a*) and 59(*g*) annular spring 300 which has an outer surface 304 and an inner surface 306 is similar to the embodiment of FIG. 47 and 48. Also, clamp 307 and stabilizing member 315 are similar to the previously described embodiment, and includes an outer plate 310' and an inner plate 312'. However, the clamp has an extra opening 322 centrally aligned with annulus 300 in outer plate 310' to receive and support handle 320. Handle 320 may be either solid, hollow, or polygonal in cross-section and threaded, cemented or otherwise attached to member 310' of clamp 307'. Stabilizing member 315 slidably extends through an offset opening 322 in clamp 307', which slidably contains the stabilizing member laterally but permits relative radial movement between the member and the annulus substantially orthogonal to the axis of the annulus during use of the device.

Referring to the embodiment of FIG. 51(*a*) and (*b*) a clamp 330 is similar to clamp 307, except an eye bolt 332 is threaded or otherwise secured to clamp 330 to extend laterally and offset from the annulus 300. Stabilizing member 315 is fastened to clamp 308 similar to the embodiments of FIG. 47 through FIG. 50(*a*), diametrically opposite eyebolt 332 and slidably extends through the eye of eyebolt 332 for providing symmetry of flexure of the annulus during jumping. Handle 320, is fastened to clamp 330 laterally offset from stabilizing member 315 for the user to grasp while being supported by clamp 330 during jumping motion.

Referring to FIG. 52, and FIG. 53 the exercise device is similar to that previously described and shown in FIGS. 47 through FIG. 51(*a*), except that clamp 330,, instead of having an eyebolt 332, has a headed bolt member 340 extending through an elongate slot 341 in a stabilizing member 342. A bolt 344 also extends through slot 341 of stabilizing member 342 to provide relative movement of the stabilizing member 342 and the annulus while keeping the member 342 substantially longitudinally aligned with handle 320 to provide symmetry of flexure of the annulus. Stabilizing member 342 instead of being clamped to a clamp, such as 308 as previously described may be bent orthogonally to provide a portion 345 of which is fastened to the annulus by a nut and bolt.

It will be apparent to those skilled in the art that various modifications and variations can be made in the exercise device of the present invention and in the manner in which the various parts are attached and assembled. As an example, the annular member, weight adjuster, and arcuate segment, all may be tubular in cross section. Foot supports 60 may also be tubular. Although, the invention is illustrated as comprising a circular, elliptical, U-shaped, and tear-drop shaped spring member, it is contemplated that other annular configurations may be used. Thus, it is intended that the present invention cover the modifications and variations of this invention provided they come within the scope of the appended claims and their equivalents.

What I claim is:

1. An exercise device for bouncing a user carried by the device from a utility surface, comprising:

at least an elongate resilient member having opposite ends;

means connecting the opposite ends in juxtaposition forming an annulus having a tear drop configuration when in an unflexed state with a supporting portion, said supporting portion having a foot support and a handle spaced in a longitudinal direction from the foot support for grasping by a user when standing on the foot support, said annulus bouncing a user off the utility surface engaged by the annulus upon the flexing of the annulus in response to a jumping motion of a user supported by the supporting portion; and a stabilizing member slidably mounted to the supporting portion and fixedly mounted to the annulus for maintaining substantial symmetry of flexure in response to a compressive and recovery force in the longitudinal direction.

2. The device of claim 1 further comprising a housing enclosing the periphery of the annulus.

3. The device of claim 1 wherein the connecting means includes a rigid linear member extending perpendicular to the longitudinal direction.

4. The device of claim 1 wherein the connecting means includes an elongate rigid member sandwiched between opposing surfaces of the supporting portion of the formed elongate resilient member.

5. The device of claim 4 wherein the handle and foot support are attached adjacent opposite ends of the elongate rigid member.

6. The device of claim 5 wherein the elongate rigid member and at least one of the foot support and the handle constitute a unitary member.

7. The device of claim 1 wherein the elongate resilient member is uncurved in the unstressed state.

8. The device of claim 1 wherein the elongate resilient member is arcuate in configuration in the unstressed state.

9. The device of claim 1 wherein the elongate resilient member is U-shaped in configuration in the unstressed state.

10. The device of claim 1 wherein the elongate resilient member is non-metallic.

11. The device of claim 1 wherein the elongate resilient member is spring steel.

12. The device of claim 1 wherein at least a portion of the elongate resilient member is substantially rectangular in cross section.

13. An exercise device for bouncing a user carried by the device from a utility surface, comprising:

spring means having a peripheral annulus for bouncing a user with a predetermined weight range off the utility surface engaged by the annulus upon the flexing of the annulus in response to a jumping motion of the user;

stabilizing means mounted to the annulus at substantially diametrically opposite locations for maintaining substantial symmetry of flexure of the annulus in response to a compressive and recovery force;

a foot support mounted on either said spring means or said stabilizing means for supporting the weight of a user at times when the spring means is upright and engaging the utility surface; and an elastomeric band mounted to opposite locations of the peripheral annulus, said locations being spaced intermediate the said opposite locations of the stabilizing means for resisting compressive force and augmenting recovery force of the spring means, said elastomeric band being a continuous loop diametrically encircling the peripheral annulus.

14. An exercise device for bouncing a user carried by the device from a utility surface, comprising:

a spring having a peripheral annulus for bouncing a user off the utility surface engaged by the annulus upon the flexing of the annulus in response to a jumping motion of the user;

a stabilizing member having one end fixedly mounted to the annulus and laterally offset therefrom, said stabilizing member being slidably mounted to the annulus substantially diametrically opposed to the one end of the stabilizing member and offset from the annulus to provide symmetry of flexure during jumping; and a handle mounted to the annulus for grasping by the user during jumping.

15. The device of claim 14 wherein a clamp is fixed to the annulus; and the one end of the stabilizing member is attached to the clamp laterally offset from the annulus.

16. The device of claim 15 wherein a second clamp is fixed to the annulus diametrically opposite the first clamp; and the stabilizing member is slidably attached to the second clamp.

17. The exercise device of claim 16 wherein, the second clamp has opening offset from the annulus, said stabilizing member being slidably mounted in said opening.

18. The exercise device of claim 16 wherein the second clamp includes an elongate member telescopically mounted to the stabilizing member.

19. The exercise device of claim 16 wherein the first clamp is integral with the one end of the stabilizing member, the stabilizing member having a longitudinally extending elongate slot, and the second clamp having a projection extending through the slot for containing the stabilizing member laterally but permitting relative radial movement of the stabilizing member and annulus.

20. The exercise device of claim 16 wherein the second clamp is a U-shaped hinge enclosing an inner and outer surface of the annulus.

21. The exercise device clamp of claim 14 wherein the second clamp includes an eyebolt extending from on edge of the second clamp offset from the annulus, and said stabilizing member slidably extends through the eyebolt.

* * * * *

UNITED STATES PATENT AND TRADEMARK OFFICE

CERTIFICATE OF CORRECTION

PATENT NO. : 5,292,295

DATED : March 8, 1994

INVENTOR(S) : MICHAEL J. GERLACH

It is certified that error appears in the above-indentified patent and that said Letters Patent is hereby corrected as shown below:

Claim 21, column 18, line 19, change "on" to --one--.

Signed and Sealed this

Twenty-third Day of August, 1994

Bruce Lehman

*Attest:*

BRUCE LEHMAN

*Attesting Officer*

*Commissioner of Patents and Trademarks*